United States Patent [19]

Secord

[11] Patent Number: 4,970,930

[45] Date of Patent: Nov. 20, 1990

[54] MUSICAL INSTRUMENT STRING CLAMP AND CUTTER

[76] Inventor: Shane W. Secord, 10603 Aquaway South, Seattle, Wash. 98168

[21] Appl. No.: 484,249

[22] Filed: Feb. 26, 1990

[51] Int. Cl.[5] ..... G10D 3/14

[52] U.S. Cl. ..... 84/306; 84/304

[58] Field of Search ..... 84/200–208, 84/304–306, 312

[56] References Cited

U.S. PATENT DOCUMENTS

| | | | |
|---|---|---|---|
| 310,590 | 1/1885 | Hyde | 84/306 |
| 542,157 | 7/1895 | Gosse | 84/306 |
| 1,531,458 | 3/1925 | Staples | 84/305 |
| 1,660,267 | 2/1928 | Hughes | 84/305 |
| 4,498,366 | 2/1985 | Carr | 84/306 |
| 4,748,889 | 6/1988 | Schaller | 84/304 |
| 4,827,825 | 5/1989 | Goto et al. | 84/306 |
| 4,872,388 | 10/1989 | Gunn | 84/304 |

FOREIGN PATENT DOCUMENTS

| | | | |
|---|---|---|---|
| 2525793 | 10/1983 | France | 84/304 |
| 2116768 | 9/1983 | United Kingdom | 84/313 |

*Primary Examiner*—Lawrence R. Franklin

*Attorney, Agent, or Firm*—Dowrey, Cross & Cole

[57] ABSTRACT

A string cutting and clamping apparatus for a stringed instrument which includes an axial bore in the string winding shaft and a screw threaded cutting and clamping stem mounted therein. The wall of the shaft is provided with aligned openings adjacent the bottom of the bore for reception of a string to be cut and clamped. The stem is advanced by turning in the bore and the bottom edge surface of the stem severs the string by shearing action against the inner edge of one of the openings. Continued advancing of the stem clamps the severed end of the string against the flat bottom surface of the bore. The bottom surface of the bore is spaced a distance below the cutting edge of the opening so that the string is completely severed as the stem passes the cutting edge of the opening.

6 Claims, 1 Drawing Sheet

FIG. 1
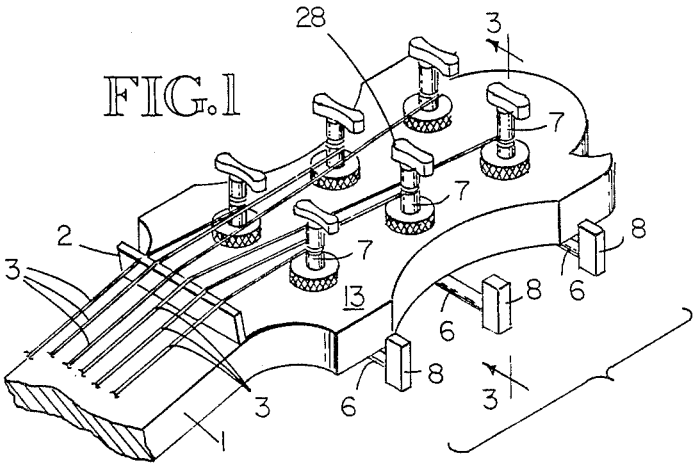
FIG. 2
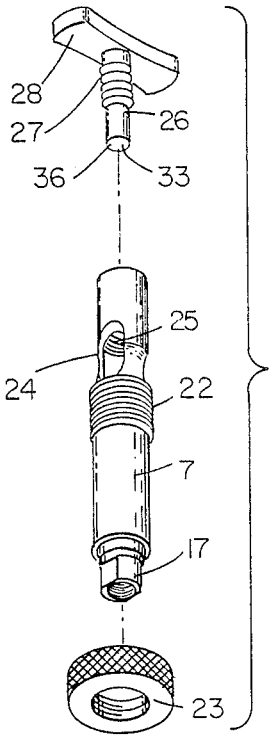
FIG. 3
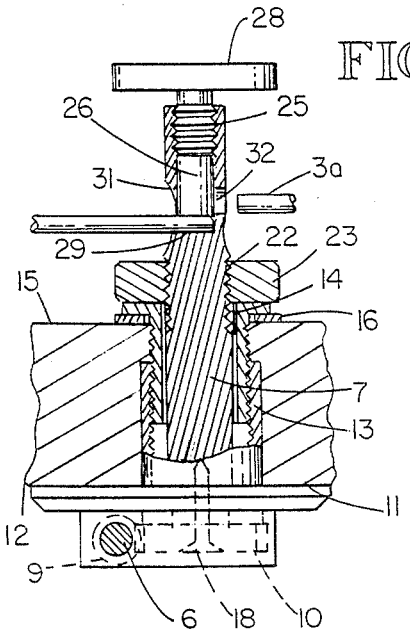
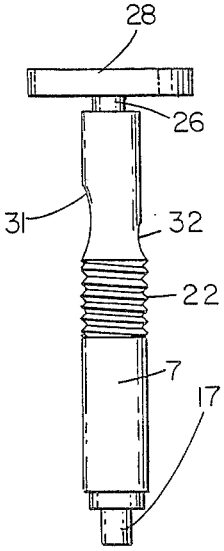
FIG. 4

MUSICAL INSTRUMENT STRING CLAMP AND CUTTER

BACKGROUND OF THE INVENTION

1. Field of the Invention:

The present invention relates generally to an apparatus for mounting musical instrument strings and more particularly to an apparatus for clamping a string to the winding post or shaft of the tuning peg or key assembly on the neck of the instrument. The apparatus of the present invention enables an individual string to be clamped to the winding post and automatically cut to length, eliminating excess string without the use of hand held cutters or clippers. The cutting and clamping operations are performed simultanteously in a rapid and efficient manner on the winding post requiring only one hand.

2. Description of the Prior Art:

In the prior art the individual strings of a stringed instrument such as a guitar, banjo or violin are strung by attaching one end at the bridge of the body of the instrument and extending the string over the nut located across the neck of the instrument. From there it is wound about a tuning peg or key which is used to hand tension the string for pitch tuning. The British patent application GB No. 2116768A to Rose illustrates a typical arrangement for instruments such as electric guitars wherein the bank of tuning pegs 17 include winding posts corresponding in number to the strings of the instrument. The strings are wound about the winding posts and tightened by means of the individual tuning pegs. G. A. Staples and G. Hughes U.S. Pat. Nos. 1,531,458 and 1,660,267 respectively illustrate classic examples of tuning peg arrangements for tensioning the individual strings of a violin. As illustrated most clearly in the Staples patent, the individual strings are wrapped about the tuning pegs which are hand operated to tension the strings and thereby pitch tune each individual string. The problem with prior art tuning peg arrangements such as those illustrated is twofold. The first problem is that of effectively clamping, winding or otherwise attaching the string securely to the tuning peg or a winding shaft for tensioning. Secondly, when replacing a string, the string is usually several inches longer than required for the length of the instrument and the excess must be cut off. Since the strings are usually made of hardened steel this requires some sort of hand held clippers or cutters. As often occurs, the installation of a new string may be required during a performance and is cumbersome and time consuming to the detriment of the performance.

SUMMARY OF THE INVENTION

According to the present invention the winding shaft or tuning peg is so constructed that a string may be passed through the body of the winding member and simultaneously clamped and the excess portion cut in a single operation without the use of hand held cutters or clippers. A new string may thus be installed in a matter of seconds requiring minimal interruption during a band performance or the like. The clamping and cutting of the string is a quick and positive operation. The string may be released by a reverse operation of the cutter-clamp.

BRIEF DESCRIPTION OF THE DRAWINGS

FIG. 1 is a perspective view showing the neck and head portion of a stringed instrument mounting the clamp and cutter apparatus of the present invention;

FIG. 2 is an exploded view of the winding post incorporating the clamp and cutter mechanism;

FIG. 3 is a cross-sectional view taken along lines 3—3 of FIG. 1; and FIG. 4 is a side elevational view of the winding post of the present invention.

DESCRIPTION OF THE PREFERRED EMBODIMENT

Referring now to the drawings, the clamp and cutter apparatus of the present invention is illustrated in FIG. 1 as being mounted on a guitar utilizing one form of a conventional winding post or shaft arrangement wherein the posts extend outwardly from the surface of the neck. Although the preferred embodiment is being described in connection with use on a particular guitar, it will be understood that the invention is equally applicable to other stringed instruments such as banjos, cellos, violins or even pianos. Although outwardly projecting winding posts are illustrated in the drawings, it will be appreciated by those skilled in the art that the cutter-clamp may be mounted directly to the cross shaft of a classic tuning peg such as used with violins for instance. It will also be understood that, with respect to the present embodiment, the axial direction of the cutter clamp member within the winding post may be reversed with certain modifications of the post and gear system well within the skill of an artisan without departing from the intended scope of the invention.

FIG. 1 illustrates a typical arrangement wherein the neck portion 1 of a guitar is provided with a nut 2 over which strings 3 are tensioned for pitch tuning. The opposite ends of the strings are anchored adjacent a bridge on the body of the instrument (not shown). Each string 3 is individually tensioned by being wound on its respective tuning peg assembly indicated generally at 4. Although only the peg assemblies for one side of the neck are illustrated, it will be understood that a second set of peg assemblies are located on the opposite side. Alternately, depending on the neck design, all peg assemblies may be located on the same side of the neck. In any case, these peg assemblies may be identical and only one such peg assembly will be described in detail for the purpose of simplicity.

As shown in detail in FIGS. 2 and 3, each tuning peg assembly includes a tuning key shaft 6 and a string winding post or shaft 7. Each tuning key shaft 6 includes a knob or the like 8 on its outer end which is grasped by thumb and finger to turn the shaft. The shaft 6 is provided with a suitable journal mounting in the housing 10 on the bottom side of the neck as illustrated in FIG. 3. The opposite end of the shaft 6 within the housing 10 is provided with a worm gear 9 meshed with a suitable pinion fixed to the bottom of the winding shaft 7 as seen in FIG. 3. This structure is a well known expedient familiar in the art. Turning motion of the tuning key shaft 6 by means of the knob 8 is thus transferred to the string winding post 7 extending normal thereto.

The housing 10 includes a base 11 which seats on the bottom surface 12 of the neck 1 and an upstanding tubular extension 13 received in a suitable bore in the neck. The extension 13 is internally threaded to receive the externally threaded hollow sleeve 14 mounted in a second bore of reduced diameter opening in the top face 15 of the neck. A washer 16 may be used to protect the top surface of the neck. With this arrangement it may be seen that the housing 10, extension 13 and sleeve 14 may be clamped to the neck 1 by screw threading the sleeve 14 into the extension 13 against the washer 16 and top surface 15 of the neck. This structure provides a rotatable mounting for the shaft 7. The drive pinion carried by the bottom end of shaft 7 may be received and fixed against relative rotation on the flat surface of the reduced diameter bottom end 17 of the post. The pinion may be securely clamped to the shaft 7 by means such as a flat head screw or the like 18 threaded into the body of the shaft. In order to retain the shaft 7 against rotation in the sleeve 14, an upper portion of the shaft is provided with screw threads 22 for mounting the knurled thumb nut 23 which also has a clamping function during the novel string clamping and cutting operation presently to be described. In this regard it will be noted that the screw threads 22 are in this embodiment left handed.

The top end of the post 7 includes a central axial bore 24 which extends downwardly to a position just above the screw threads 22 and thumb nut 23. The top end of the bore 24 is provided with internal threads 25 for receiving the cutting and clamping stem 26. The stem 26 has a threaded portion 27 for engaging the threads 25 and a turning knob 28 for running the stem downwardly into the bore 24.

For reasons which will be presently explained, both the winding post 7 and the cutting and clamping stem 26 are made of standard soft steel then hardened. A flat bottom surface 29 is provided at the end of the bore 24 and serves as a clamping surface for the string as will be presently described. An enlarged opening 31 is located in the wall of the post and has an inwardly tapered edge somewhat larger than a typical string 3 to facilitate reception and threading of the string. It will be noted that in addition to being enlarged, the bottom edge of the opening is coextensive with the surface 29. This relationship allows the string to be clamped flatly on the surface once it is severed. A smaller opening 32 is formed in the post wall diametrically opposite the opening 31. The bottom edge of the opening 32 is spaced above the surface 29 a distance slightly in excess of the diameter of a string 3 as shown in FIG. 3 to ensure complete severing of the string as the stem passes the opening.

With the structure described it will be apparent from the FIG. 3 illustration that a string 3 extending through the post or shaft 7 via the openings 31 and 32 will be completely severed as the stem 26 is advanced downwardly in the bore 24 by turning the knob 28. The hardened bottom edge 33 of the stem and the hardened bottom inner edge 34 of opening 32 act as a knife and anvil to perform the cutting action on the hardened steel string. As the cutting action is completed, the end of the string 3 is simultaneously securely clamped between the bottom face 36 of the stem 26 and the bottom surface 29 of the bore 24.

The procedure in string installation is as follows. The new string 3 is initially anchored at the bridge of the instrument and the opposite end inserted through the stem 7 via the aligned openings 31 and 32. At this point the knurled thumb nut 23 is tightened against the upper surface of the hollow sleeve 14 by means of the left handed screw threads 22 to prevent rotation of the winding post 7 relative to the neck 1. The stem 26 will have been previously raised above the openings in the winding post. Once the thumb nut 23 is tightened and with the string extending through the post, the cutting and clamping stem is turned clockwise and screw threaded downwardly into the bore 24 by means of the knob 28. Since the threads 22 are left handed the post 7 will be held against turning during this motion. Once the string 3 is severed and clamped as previously described and illustrated in FIG. 3, the excess **3*a* may be discarded. The knurled thumb nut 23 is then loosened to permit rotation of the post 7 within the neck. The associated knob 8** may then be turned to rotate the post so as to wind and further tension the string in a conventional manner for pitch tuning.

The unique structural combination provided by the present invention permits the new string to be pulled taut by hand and then severed and clamped to the winding post prior to turning the post to further tighten and tune the string. In fact relatively few turns of the post are usually necessary to tune the string. In the prior art method, the string and its unattached excess end portion had to be wound about the post several times by turning the post in order to secure it to the post prior to tuning. Only then could the excess end portion be trimmed off with hand cutters. The present invention obviates this cumbersome procedure.

Although the present embodiment has been described in connection with a tuning peg assembly utilizing a separate key shaft and worm gear driven winding post, the invention may also be utilized with single shaft tuning peg assemblies. In such cases the tuning peg will extend through a peg box such as in a violin, or otherwise extend directly through the body of the neck. In any case the winding shaft or post about which the string is to be tensioned may be provided with the cutting and clamping structure described regardless of its orientation. As previously mentioned, it is also possible and within the scope of the present invention, with certain structural modifications, to extend the cutting and clamping stem in either direction within the winding post.

The present invention has been described and illustrated with respect to a specific embodiment thereof. It will be apparent to those skilled in the art, however, that modification to the structure as described may be made without departing from the spirit of the invention or from the scope of the appended claims.

What I çlaim is:

1. A winding shaft for tensioning a musical string comprising;

a cylindrical body an axial bore open at one end in one end of said body, said bore having a bottom surface at the opposite end thereof, diametrically opposed openings in said body communicating with said bore, one of said openings being enlarged for insertion of a string and located coextensive with said bottom surface, the other said openings being spaced from said bottom surface a distance equal to at least the diameter of a string, a cylindrical cutting stem in said bore, and means to selectively advance and retract said stem, whereby a string extending between said openings may be severed and clamped against said bottom surface by advancement of said stem and released by retraction thereof.

2. The apparatus of claim 1 wherein;

said stem has a screw threaded engagement with said bore and is advanced and retracted therein by relative rotation therewith, the diameter of said stem providing a close fitting engagement within said bore.

3. The apparatus of claim 2 wherein;

said stem includes a flat bottom face for engagement with a string, the circular edge thereof providing a first cutting edge, and the inner edge of the other said openings providing a second cutting edge for cooperation with said first cutting edge to sever a string upon advancement of the stem past the other said opening, the severed end of said string being clamped between the bottom face of said stem and the bottom surface of said bore.

4. The apparatus of claim 3 including means to hold said winding shaft against rotation during the cutting and clamping operations.

5. The apparatus of claim 3 wherein said winding shaft is rotatably mounted in the neck portion of a musical instrument, and means to hold said shaft against rotation relative to said neck during the cutting and clamping operation.

6. The apparatus of claim 5 wherein said holding means comprises a thumb nut in threaded engagement on the shaft, said thumb nut being tightened to bring clamping pressure against the surface of the neck, the threaded engagement between said thumb nut and shaft being oppositely directed from the screw threaded engagement between the stem and said axial bore, whereby tightening of the thumb nut against the neck holds the shaft from rotation relative to the neck during rotation of the stem in the bore.

* * * * *